United States Patent [19]

Keen

[11] 4,424,905

[45] Jan. 10, 1984

[54] GARMENT HANGER CADDY

[76] Inventor: Cletus F. Keen, 2736 S. Punta Del Este Dr., Hacienda Heights, Calif. 91745

[21] Appl. No.: 235,716

[22] Filed: Feb. 18, 1981

[51] Int. Cl.[3] ..... A47F 7/00

[52] U.S. Cl. ..... 211/49 R

[58] Field of Search ..... 211/49 R, 49 D, 59.1, 211/13, 162

[56] References Cited

U.S. PATENT DOCUMENTS

| | | | |
|---|---|---|---|
| 891,490 | 6/1908 | Lippold | 211/49 R |
| 2,122,324 | 6/1938 | McDermott | 211/49 R |
| 2,609,919 | 9/1952 | Lee | 211/49 R X |
| 2,918,174 | 12/1959 | Tabbi | 211/49 R |
| 3,490,599 | 1/1970 | Von Maur | 211/49 R |
| 3,692,188 | 9/1972 | Bayne | 211/49 D |
| 4,016,981 | 4/1977 | Hildt | 211/49 R |

FOREIGN PATENT DOCUMENTS

| | | | |
|---|---|---|---|
| 128926 | 8/1950 | Sweden | 211/49 R |

*Primary Examiner*—Ramon S. Britts

*Assistant Examiner*—Robert W. Gibson, Jr.

*Attorney, Agent, or Firm*—Harvey B. Jacobson

[57] ABSTRACT

A device for organizing, storing and dispensiing garment hangers comprises a vertically disposed glide rod for engaging the hanger hook and two vertically disposed guide rods positioned on opposite sides of said glide rod and spaced forward thereof for engaging the respective outer shoulder portions of the garment hanger, the bottom ends of the guide rods and glide rod are mounted to a base which rests on a surface while the upper surfaces of the three vertically disposed support structures are joined by a single connector to provide a sturdy structure upon which garment hangers can be stacked and the stacked hangers unloaded into large storage bins by simply turning the device upside down. One of the guide rods bends behind and around the glide rod and is joined to the other support rods by the connector whereby the configuration of the one guide rod provides only a one-way access for the garment hanger hook to be placed around the glide rod and thus insures that all of the hangers are stacked uniformly for rapid unloading and reuse.

8 Claims, 5 Drawing Figures

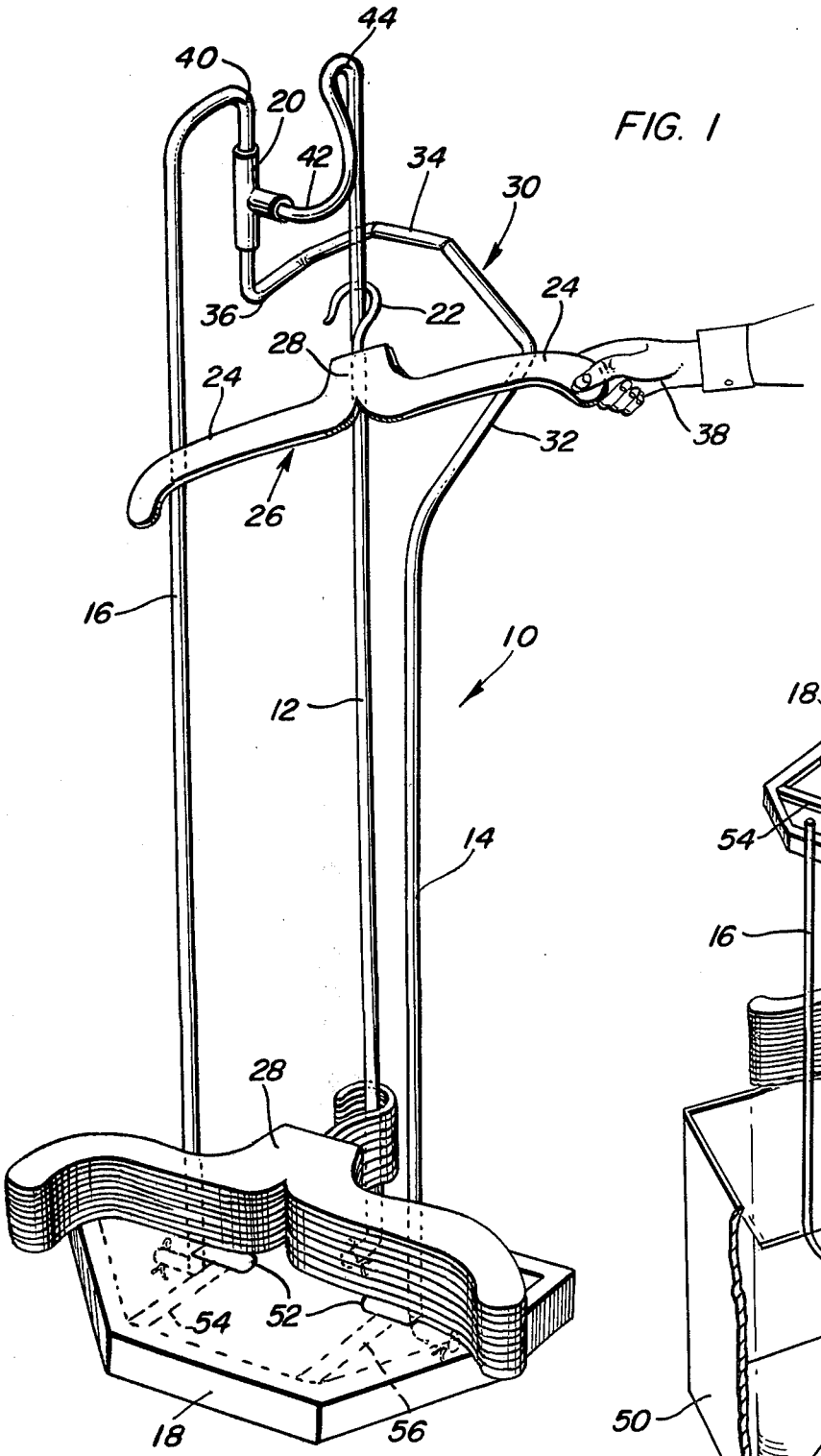
FIG. 1
FIG. 2
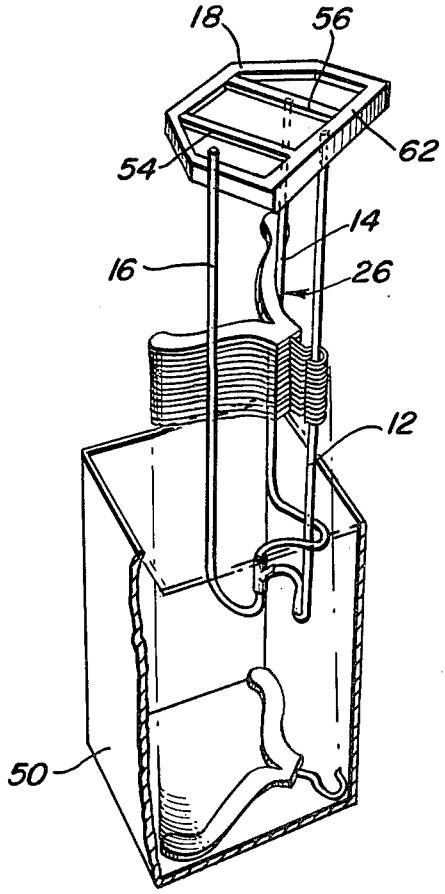

GARMENT HANGER CADDY

BACKGROUND OF THE INVENTION

1. Field of the Invention

This invention relates in general to a novel device for organizing, storing, and dispensing garment hangers.

The device of the present invention will find its greatest utility wherever large quantities of garment hangers are used, such as in clothing factories, retail clothing stores, dry cleaning plants, and the like.

Heretofore, the handling of garment hangers on a large scale has been a random and haphazard affair with the hangers usually piled helterskelter in a heap either on the floor or in small storage containers, such as cardboard boxes. To separate a hanger from such a confused heap is a frustrating and time consuming task since the hangers generally become snarled with other hangers inviting breakage and generally making a tangled mess of the entire matter. Since these hangers should be readily available when needed, anything other than systematic handling presents a condition which if not dangerous, is at least inefficient and inconvenient.

2. Description of the Prior Art

In an effort to provide an efficient means for managing what has been previously been a haphazard situation for storing garment hangers, there have been patented numerous garment hanger handling devices. For example, U.S. Pat. No. 2,918,174, issued to Tabbi, discloses a rack preferably mounted on a movable dolly in which the rack comprises a number of vertically disposed rods mounted between a pair of plates in which the rods engage and support a stack or stacks of garment hangers. U.S. Pat. No. 4,016,981, issued to Hildt, discloses a rack for storing clothes hangers having a plurality of elongated posts extending upwardly and spaced so as to engage each side edge of the neck portion of the hanger, the under edge of the neck portion of the hanger and the under side of the two shoulder portions of the hanger. U.S. Pat. No. 3,692,188, issued to Bayne, discloses a stand for storing and displaying clothes hangers including a vertical standard engaging the under edge of the neck portion of the hanger and which has a spring supported bracket thereon which supports a rack upon which the clothes hangers are stacked so that as the weight of the stack of clothes hangers varies, the vertical position of the rack varies accordingly. A vertical guide means engaging the shoulder portion of the clothes hangers extend on each side of the vertical standard. U.S. Pat. No. 2,454,858, issued to Burt, discloses a garment hanger bin which is divided into a plurality of triangular-shaped compartments, each compartment contains a vertical guide rod which engages the hanger hook, the partitions separating the bin into compartments function to retain a plurality of hangers placed on the guide rod in substantial vertical alignment. U.S. Pat. No. 3,490,599, issued to Von Maur, discloses a clothes hanger receptacle which comprises an elongated member containing a hook-shaped slot extending its entire length for receiving the hook portion of the clothes hanger.

While these prior art garment hanger organizing devices greatly assist in bringing order to what heretofore has been an inefficient and inconvenient situation, such devices do not enable the rapid stacking of garment hangers thereon and still enable each hanger to be stacked in the same direction so as to avoid entanglement of the hangers and provide efficient dispensing of the hangers from the support surfaces. Likewise, many of the prior art devices are not provided with easy access to the support surfaces. For example, in the patent to Tabbi, the user must reach underneath a top plate and grope in order to place the hanger neck hook on the guide surfaces which are not visible. Furthermore, prior art garment hanger storage devices cannot be unloaded rapidly and efficiently and still stack the hangers in a neat manner so as to be readily available when needed and which allows the immediate reloading of the device.

SUMMARY OF THE INVENTION

The present invention may be characterized as a lightweight garment hanger caddy comprising three vertically disposed rods in which the bottom ends of each rod are mounted to a base and the upper ends of each rod are joined together by a single connecting means to provide quick and permanent assembly and provide complete rigidity between the three connected rods. The vertically disposed rods comprise a central glide rod for engaging the hanger hook and two guide rods placed on opposite sides of the central glide rod for aligning the hangers by making light contact with the outer hanger shoulders as they slide down the glide rod and are stacked vertically on the base. One of the guide rods extends behind and around the central glide rod in a loop so as to provide easy access for placing the hanger hook onto the glide rod and to insure that all the hanger hooks and necks are stacked uniformly in the same direction as the hangers slide by gravity down the glide rod. The central glide rod includes a nose portion positioned at the upper end of the caddy formed by bending the glide rod back against itself, the nose portion allows unobstructed removal of the hangers and provides rigidity as well as directs the hangers during unloading onto a horizontal row of hang-bars or into storage containers quickly and neatly and in a manner that will allow reloading or immediate reuse.

Accordingly, it is an object of the present invention to improve the handling of garment hangers.

In accordance with the aforementioned object, another object of the invention is to provide an efficient apparatus for organizing, storing and dispensing garment hangers.

Another object of the invention is to provide a lightweight, sturdy device for uniformly storing garment hangers.

Still another object of the invention is to provide a garment hanger storage device which can be rapidly and uniformly unloaded to allow immediate reloading or reuse.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the garment hanger caddy of the present invention, the caddy being shown in the loading or stacking mode.

FIG. 2 is a perspective view, partly broken away, illustrating the unloading or dumping mode of the garment hanger caddy.

DETAILED DESCRIPTION OF THE INVENTION

Figure 3:
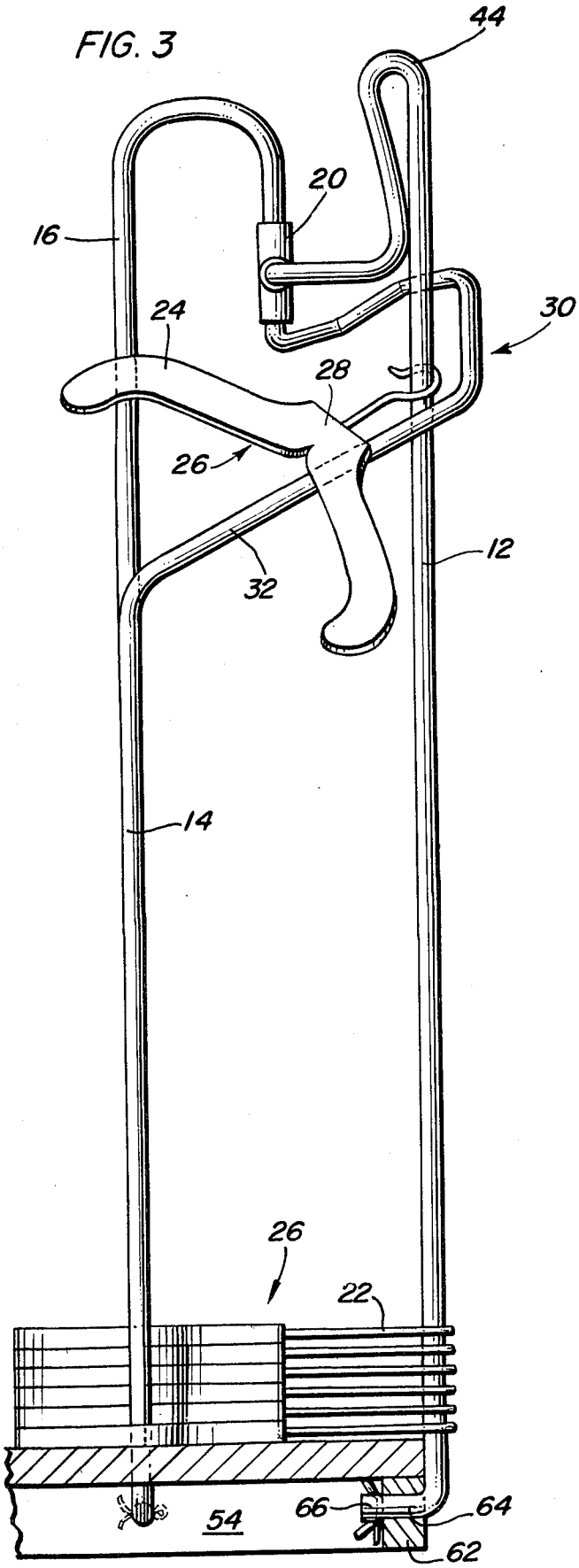
FIG. 3 is a side elevation view of the garment hanger caddy in which the base is shown in section.

Referring to FIG. 1, the garment hanger caddy of the present invention for uniformly stacking, storing and unloading a plurality of garment hangers is generally indicated by reference numeral 10. Hanger caddy 10 comprises three vertically disposed rods including central glide rod 12 and a pair of right and left guide rods 14 and 16 placed on opposite sides of glide rod 12. The three rods are attached at the lower ends thereof to base 18. The other or upper end of each support rod is joined to the others by a single connecting means, a T-shaped compression connector 20 which joins the three upper ends of the support rods to allow garment hanger caddy 10 to be quickly and permanently assembled and yet have a rigid construction.

Figure 4:
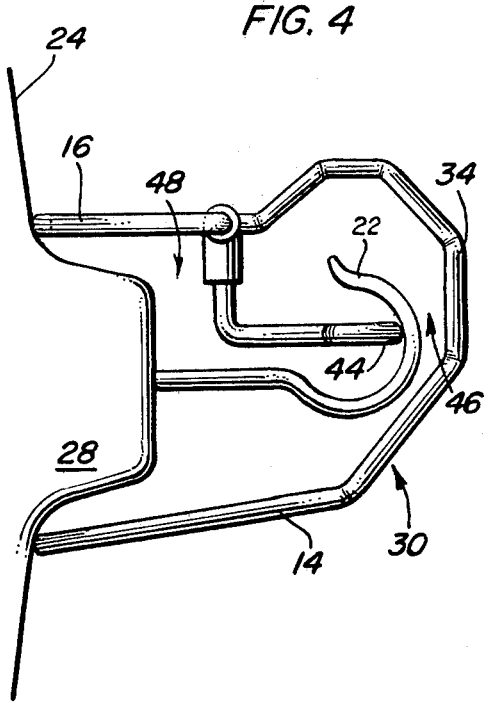
FIG. 4 is a partial top elevational view of the garment hanger caddy.

Referring now to FIGS. 1, 3 and 4, it can be seen that the right and left guide rods 14 and 16, respectively, are positioned at a location spaced laterally from central glide rod 12 and forward thereof. This configuration of the three support rods allows glide rod 12 to engage hanger hook 22 and guide rods 14 and 16 to lightly contact respective outer shoulders 24 of garment hanger 26 during loading, storing and unloading garment hanger caddy 10. In order that each garment hanger 26 is uniformly stacked so that hanger hook 22 of each garment hanger 26 faces the same direction, right guide rod 14 is provided with an alignment loop 30. Alignment loop 30 comprises a rearward extending portion 32 and a rear laterally extending portion 34 and a connecting portion 36 which fits within T-connector 20 adjacent left guide rod 16, alignment loop 30 therefor, being a continuous loop passing behind glide rod 12. Alignment loop 30 and the visible central glide rod 12 allow the individual garment hangers 26 to be hooked on glide rod 12 by hand 38 of a user from substantially any direction except the left side of caddy 10 or more particularly, the side containing the straight guide rod such as guide rod 16 and still provide uniform stacking of hangers 26 when released. Alignment loop 30 renders glide rod 12 visible and thus readily accessible and assures hanger hooks 22 are aligned and placed in the same direction during movement down glide rod 12. Attempts to place garment hangers 26 on central glide rod 12 from the left of hanger caddy 10 will fail as guide rod 16, T-connector 20 and connecting portion 42 will prevent hanger hook 22 from being properly hooked or slid downward on glide rod 12. This essential "one-way" loading of hangers 26 insures uniform stacking and prevents any entanglement of hanger hooks 22 during stacking, storage and, in particular, during unloading, since hooks 22 placed in the opposite direction as shown in FIG. 1 will prevent unloading as the hanger hooks will get caught by the connecting pieces attached to T-connector 20. The visibility of glide rod 12 due to the configuration of alignment loop 30 allows easy access and rapid loading of garment hanger caddy 10.

T-connector 20 receives at the lower end thereof connecting portion 36 from right guide rod 14, at the upper end connecting portion 40 from left guide rod 16, and connecting portion 42 from central glide rod 12 at the base, in which the cross bar of T-connector 20 is in a vertical orientation. Of course, the specific orientation of connector 20 is not critical so long as the support rods of garment hanger caddy 10 can be joined so as to provide a sturdy construction and allow unobstructed hanger removal, either individually or in a complete stack at one time for transfer onto other storage facilities.

The unloading mode of garment hanger caddy 10 can be described with reference to the structure of garment hanger caddy 10 illustrated in FIGS. 1, 2 and 4. Placed at the upper end of glide rod 12 preceding connecting portion 42 is nose 44 formed by bending glide rod 12 back upon itself which provides for a more sturdy construction. Nose 44 must be small enough to enable hanger hook 22 to pass unobstructed during unloading of hangers 26, either individually or in a complete stack at one time. Similarly, space 46 existing between nose 44 and lateral rear portion 34 of alignment loop 30 must be large enough to enable the unobstructed unloading of garment hangers 26 from garment hanger caddy 10. Also, the displacement generally indicated by reference numeral 48 existing between left guide rod 16 and connector 20 should be sufficient so that hanger neck 28 and hanger shoulders 24 pass unobstructed from garment hanger caddy 10 to a separate storage facility during unloading. To unload garment hangers 26 from garment hanger caddy 10, caddy 10 is simply oriented to allow garment hangers 26 to slide over glide rod 12 onto a separate storage facility. Alignment loop 30 may serve as a carrying handle during unloading. During unloading, nose 44 is aligned with the surface which is to receive the garment hangers from caddy 10 and the hangers slid along the glide rod passing unobstructed onto the separate storage facility. In FIG. 2, the unloading mode is shown as dumping a stack of hangers from hanger caddy 10 into storage box 50 in which caddy 10 is turned upside down with nose 44 aligned with one corner of storage box 50, the stack of garment hangers 26 sliding off glide rod 12 as they fall into storage container 50. Likewise, if the stack of hangers is to be transferred onto a horizontal hang bar, hanger caddy 10 is simply tilted in the horizontal position with nose 44 aligned with the hang bar, the stack of hangers being pushed along glide rod 12 for transfer thereto. In such an instance, it would also be possible to lift base 18 slightly so the hangers will slide along glide rod 12 due to gravity. The rapid and uniform unloading of a stack of garment hangers from garment hanger caddy 10 is a vast improvement over prior art attempts to manage what previously has been an unruly situation for storing and using garment hangers.

Figure 5:
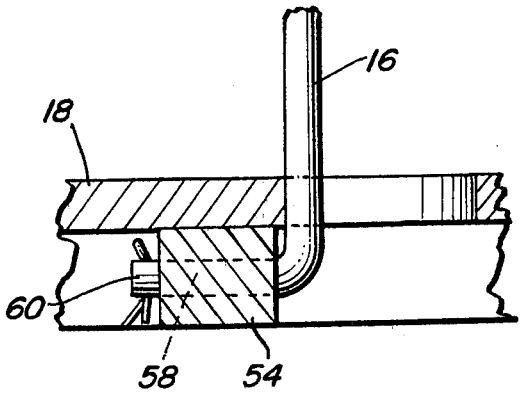
FIG. 5 is a sectional view illustrating the placement of one of the vertically disposed rods on the base of the garment hanger caddy.

Referring now to FIGS. 1, 3 and 5, base 18 contains a pair of slots 52 on the surface thereof for supporting respective guide rods 14 and 16. Underneath the base are a pair of cross braces 54 and 56 which pass adjacent slots 52. The respective guide rods contain a 90° bend along the bottom thereof to form attachment extension 58 which passes through slot 52 underneath the top surface of base 18 and through one of the respective cross brace 54 or 56. An end cap 60 allows the end of the guide rod to be secured on the other side of cross brace 54 or 56 and provides the guide rod with rigidity. A separate cross brace 62 is formed on the under side of base 18 along the width thereof for supporting glide rod 12. At the bottom end of glide rod 12, an attachment portion 64 is bent at a 90° angle from the vertical orientation of glide rod 12. Glide rod 12 passes directly behind and underneath the top surface of base 18 and attachment portion 64 enters a pre-drilled hole in cross brace 62. End cap 66 secures glide rod 12 in the same manner as end caps 60 secure the pair of guide rods.

Garment hanger caddy 10 will accept all types of hangers, such as small or large, swivel neck hangers or rigid neck hangers, plastic, wood or metal, curved shoulder hangers or straight face or flat pants hangers. Garment hanger caddy 10 is easily portable, and can be made from lightweight metals, sturdy plastics, wood, or combinations thereof. The easy and visible accessibility of glide rod 12 and the configuration of the guide rods allows only "one-way" loading of the hanger hooks on glide rod 12, insuring uniform stacking of the garment hangers by merely hooking the hanger hook around the exposed glide rod and letting hanger drop in place. Further, the configuration of garment hanger caddy 10 allows unobstructed, rapid, uniform unloading of the hangers from the caddy thus permitting the hangers to be immediately ready for use and allowing garment hanger caddy 10 to be free for immediate reuse. Garment hanger caddy 10 can be structured to hold approximately 75 hangers or more, the loaded caddies being stored by standing them against a storage wall or even hanging from wall hooks without taking up large amounts of storage space. The simple and lightweight structure of the device also renders it readily acceptable for use in retail fashion stores, workshops, etc.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A garment hanger caddy for storing and dispensing garment hangers comprising: a base, a hook-engaging support extending vertically from said base, a pair of spaced supports extending vertically from said base for engaging the respective outer shoulders of a garment hanger, a horizontal loop carried by one of said spaced supports passing behind and spaced from said hook-engaging support above said base, the spacing of said loop from said hook-engaging support allowing unobstructed unloading of said caddy by sliding the hangers off said hook-engaging support and said alignment means.

2. The caddy of claim 1 wherein said hook-engaging support and said pair of spaced vertically extending supports include bottom ends which are supported from said base and upper ends, said loop being disposed at an upper end of said one spaced supports, said supports being configured so as to allow hangers to be stored adjacent said base and be unloaded by sliding said hangers from adjacent said base to and beyond said loop.

3. The caddy of claim 2 wherein said upper ends of said supports are joined together by a single connecting means including said loop.

4. The caddy of claim 3 wherein said pair of spaced supports are placed on opposite sides of said hook-engaging support and forward thereof, said loop being spaced below the upper ends of said hook-engaging support and the other of said spaced supports, the rear and opposite sides of the upper end of said hook-engaging support being unobstructed so as to provide accessibility to the upper end of said hook-engaging support from the rear and the side thereof adjacent the one spaced support.

5. The caddy of claim 3 wherein said hook-engaging support comprises a central glide rod, said other spaced support extending above said loop thereby preventing access of a hanger hook to said glide rod from the direction of said other support.

6. The caddy of claim 5 wherein said connecting means joins the upper ends of said spaced supports and slide rod at a location on the side of said guide rod opposite said one spaced support.

7. A garment hanger caddy for storing and dispensing garment hangers comprising an elongated first member for engagement by a hanger hook, and a pair of elongated second members generally paralleling said first member and for engagement with the respective outer shoulders of a hanger, first means stationarily interconnecting one set corresponding ends of said members, second means interconnecting the other set of ends of said members to provide rigidity, said second means including a loop integral with the other ends of said second members and disposed in a plane generally normal to said members and spaced from said one ends of said first member and one of said second members, said loop passing behind and being spaced from said one member.

8. A garment hanger caddy for storing and dispensing garment hangers comprising a central vertically extending hook-engaging support means, a pair of spaced vertically extending support means capable of engaging the outer shoulder portions of said hanger when hooked around said central support means, the upper end portion one of said pair of spaced support means including an alignment loop passing behind and around said central hook-engaging means so as to align the hanger hooks of a hanger engaged with said hook-engaging support when released for movement down said hook-engaging support means so as to face the same direction.

* * * * *